US008755554B2

(12) United States Patent
Kuhtz et al.

(10) Patent No.: US 8,755,554 B2
(45) Date of Patent: Jun. 17, 2014

(54) EARPHONE AND HEADSET

(75) Inventors: Jan Peter Kuhtz, Celle (DE); Kornelia Kaddig, Wietze (DE)

(73) Assignee: Sennheiser electronc GmbH & Co. KG, Wedemark (DE)

( * ) Notice: Subject to any disclaimer, the term of this patent is extended or adjusted under 35 U.S.C. 154(b) by 120 days.

(21) Appl. No.: 13/472,573

(22) Filed: May 16, 2012

(65) Prior Publication Data

US 2013/0022228 A1 Jan. 24, 2013

(30) Foreign Application Priority Data

May 20, 2011 (DE) ..... 10 2011 076 179

(51) Int. Cl.
*H04R 25/00* (2006.01)
*H04R 1/10* (2006.01)

(52) U.S. Cl.
CPC ..... *H04R 1/1033* (2013.01)
USPC ..... 381/372; 381/370

(58) Field of Classification Search
USPC ..... 381/370, 372, 374–383
See application file for complete search history.

(56) References Cited

U.S. PATENT DOCUMENTS

| | | | | |
|---|---|---|---|---|
| 5,469,505 | A | 11/1995 | Gattey et al. | |
| 2001/0043711 | A1 * | 11/2001 | Hashimoto et al. | 381/370 |
| 2004/0165720 | A1 | 8/2004 | Paulson et al. | |
| 2005/0236769 | A1 * | 10/2005 | Wei | 381/370 |
| 2009/0041261 | A1 | 2/2009 | Fickweiler et al. | |

FOREIGN PATENT DOCUMENTS

| | | |
|---|---|---|
| DE | 39 06 622 | 9/1989 |
| DE | 42 26 471 | 2/1993 |
| DE | 10 2007 037 024 | 2/2009 |
| JP | 2010/252132 | 11/2010 |

* cited by examiner

*Primary Examiner* — Brian Ensey
(74) *Attorney, Agent, or Firm* — Frommer Lawrence & Haug LLP

(57) ABSTRACT

Thus there is provided an earphone or headset comprising at least one electroacoustic reproduction transducer for the reproduction of audio signals, an electric connecting cable, and a damping unit for damping solids-borne sound transmitted by the connecting cable. The damping unit is in the form of a separate component.

9 Claims, 3 Drawing Sheets

EARPHONE AND HEADSET

The present application claims priority from German Patent Application No. DE 10 2011 076 179.9 filed on May 20, 2011, the disclosure of which is incorporated herein by reference in its entirety.

BACKGROUND OF THE INVENTION

1. Field of the Invention

The present invention concerns an earphone and a headset.

2. Description of Related Art

It is noted that citation or identification of any document in this application is not an admission that such document is available as prior art to the present invention.

Both earphones and also headsets can be operated wirelessly or in a wired configuration. The wired earphones or headsets have a connecting cable, typically with a jack plug. The cable is then used for transmission of the audio signals from an audio source to the earphone or the headset.

If the connecting cable is rubbed against the clothing of the user or against objects or comes into contact with the object then that can involve a transmission of solids-borne sound along the connecting cable to the electroacoustic reproduction transducer of the earphone or headset.

U.S. 2004/0165720 A1 discloses a headset having a connecting cable. The connecting cable is provided with a spiral-shaped portion for the avoidance of transmission of solids-borne sound through the connecting cable. Longitudinally directed forces in the cable can be converted by the spiral-shaped portion into rotational and flexural forces within that spiral-shaped portion.

As state of the art attention is directed to the documents DE 39 06 622 A1, DE 42 26 471 A1, DE 10 2007 037 024 A1, U.S. 20004/0165720 A1, U.S. Pat. No. 5,469,505 A and JP 2010 252132 A.

It is noted that in this disclosure and particularly in the claims and/or paragraphs, terms such as "comprises", "comprised", "comprising" and the like can have the meaning attributed to it in U.S. patent law; e.g., they can mean "includes", "included", "including", and the like; and that terms such as "consisting essentially of" and "consists essentially of" have the meaning ascribed to them in U.S. patent law, e.g., they allow for elements not explicitly recited, but exclude elements that are found in the prior art or that affect a basic or novel characteristic of the invention.

It is further noted that the invention does not intend to encompass within the scope of the invention any previously disclosed product, process of making the product or method of using the product, which meets the written description and enablement requirements of the USPTO (35 U.S.C. 112, first paragraph) or the EPO (Article 83 of the EPC), such that applicant(s) reserve the right to disclaim, and hereby disclose a disclaimer of, any previously described product, method of making the product, or process of using the product.

SUMMARY OF THE INVENTION

An object of the present invention is to improve solids-borne sound decoupling of an earphone or headset.

Thus there is provided an earphone or headset comprising at least one electroacoustic reproduction transducer for the reproduction of audio signals, an electric connecting cable and a damping unit for damping solids-borne sound transmitted by the connecting cable. The damping unit is in the form of a separate component. The damping unit has a first and second opening for receiving the connecting cable. The connecting cable is threaded in through the first and second openings. The length of the portion of the connecting cable between the first and second openings can optionally be greater than the distance between the first and second openings. In that way it can be provided that solids-borne sound which is transmitted through the connecting cable goes on to the damping unit and is damped therein so that the solids-borne sound cannot be further transmitted through the connecting cable.

In an aspect of the present invention the damping unit has a slot or cut between the first or second opening and an outside of the damping unit. That slot serves for threading the connecting cable in and out.

In a further aspect of the invention the slot is of a spiral configuration. The spiral configuration of the slot can prevent the cable being mistakenly removed from the first or second opening.

In a further aspect of the invention the material of the damping unit is a material different from the material of the connecting cable. That makes it possible to ensure that the damping unit does not have the same resonance frequency as the connecting cable.

In a further aspect of this invention the material of the damping unit is of a hardness of between 55 and 95 Shore.

The invention also concerns a headset comprising at least one electroacoustic reproduction transducer for the reproduction of audio signals, an electric connecting cable, and a damping unit for damping solids-borne sound transmitted by the connecting cable. In that case the damping unit is in the form of a separate component. The damping unit has a first and a second opening for receiving the connecting cable. The connecting cable is threaded in through the first and second openings. The length of the portion of the connecting cable between the first and second openings can optionally be greater than the distance between the first and second openings. It is thus possible to provide that solids-borne sound which is transmitted through the connecting cable goes on to the damping unit and is damped therein so that the solids-borne sound cannot be further transmitted through the connecting cable.

The invention concerns the notion of providing a sound damper or a damping unit on a connecting cable of an earphone or a headset. That sound damper is preferably not part of the cable but is subsequently fitted. The sound damper can optionally be removed. The sound damper can optionally be displaceable along the length of the connecting cable.

The sound damper preferably has two holes or openings for receiving the connecting cable. Optionally the holes can have slots at the two openings or holes, so that the sound damper can be removed from the connecting cable.

The sound damper preferably has a different resonance frequency from that of the connecting cable.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Figure 1:
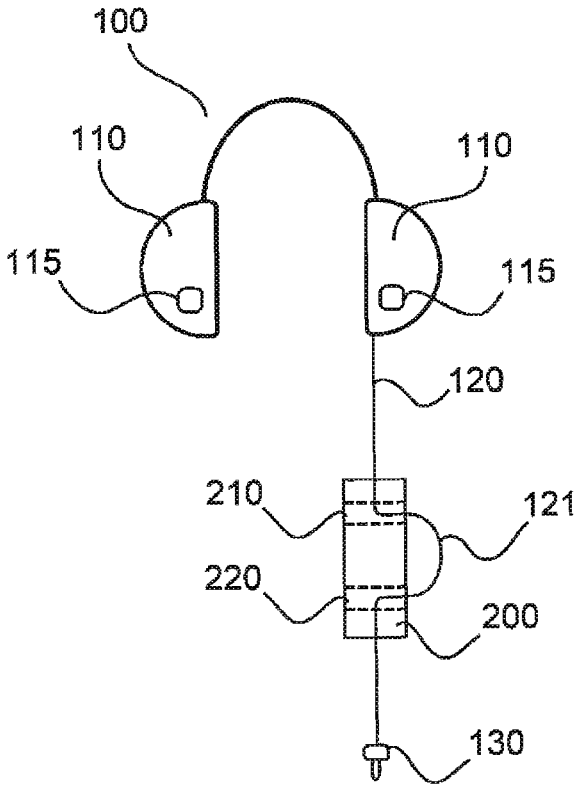
FIG. 1 shows a diagrammatic view of an earphone or a headset according to a first embodiment.

FIG. 1 shows a diagrammatic view of an earphone or headset according to a first embodiment. The earphone or headset 100 has two ear caps 110 each having an electroacoustic reproduction transducer 115, a connecting cable 120 and a plug 130. The plug 130 can be fitted into an audio source so that audio signals can be transmitted by way of the connecting cable 120 to the electroacoustic reproduction transducers 115 in the ear caps 110. As an alternative thereto the earphone or headset can also be in the form of an in-ear earphone or in-ear headset.

A damping unit 200 is provided along the connecting cable 120. The damping unit has first and second openings 210, 220 (at the ends or in the form of through holes) which serve for threading the connecting cable in and out. A loop 121 of the connecting cable 120 can optionally be formed between the two openings 210, 220. In that way the length of the cable or the loop 121 can be greater than the distance between the first and second openings 210, 220.

Figure 2:
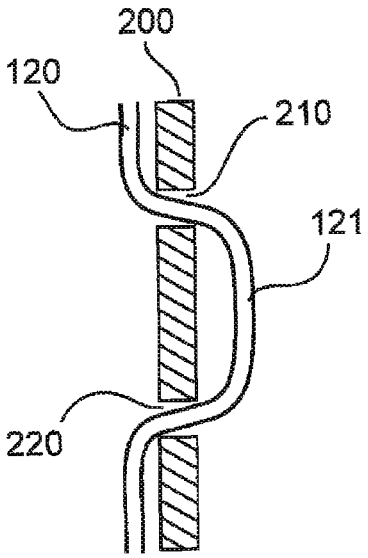
FIG. 2 shows a diagrammatic sectional view of a damping unit according to a second embodiment.

FIG. 2 shows a diagrammatic sectional view of a damping unit according to a second embodiment. The damping unit 220 of the second embodiment can be based on the damping unit 200 of the first embodiment. The damping unit 200 has first and second openings 210, 220 (at the ends or in the form of through holes). The first and second openings 210, 220 serve for threading in the connecting cable 120. The region 121 of the connecting cable 120 between the first opening 210 and the second opening 220 can represent for example at least partially a loop.

Preferably the material of the damping unit 200 is a material different from the material of the connecting cable 120. In that way the length of the cable or the loop 121 can be greater than the distance between the first and second openings 210, 220.

The material of the damping unit 200 can be of a hardness of between 55 and 95 ShA Shore. The damping unit 200 can be in the form of an elastomer spring. Optionally the resonance frequency of the damping unit is different from the natural frequency of the cable. Optionally multi-component elements can be used.

Optionally the openings 210 can be in the form of receiving bores or through bores.

Figure 3:
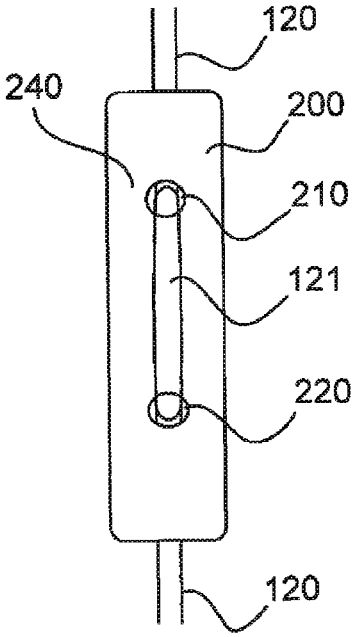
FIG. 3 shows a plan view of a damping unit according to a second embodiment.

FIG. 3 shows a plan view of a damping unit according to the second embodiment. In that case the damping unit 200 is optionally of a substantially rectangular configuration and has a first opening or receiving bore 210 and a second opening or receiving bore 220. The connecting cable 120 extends through the first receiving bore 210 to the second receiving bore 220. The portion 121 of the connecting cable 120 between the first and second receiving bores 210, 220 preferably represents a loop. As a result the length of the cable or loop 121 can be greater than the distance between the first and second openings 210, 220.

Optionally for example a slot 240 can be provided between the receiving bores or openings 210, 220 and the outside of the damping unit 200, whereby the connecting cable 120 can be removed from the receiving bore. The damping unit can thus be fitted and removed. That also makes it possible for already existing earphones or headsets to be retro-fitted with the damping unit.

The damping unit according to the invention makes it possible to effectively avoid interference sound from being coupled into the ear caps by way of the connecting cable. The damping unit 200 is preferably removable. The required damping can be tuned by selection of the material of the damping unit.

Figure 4:
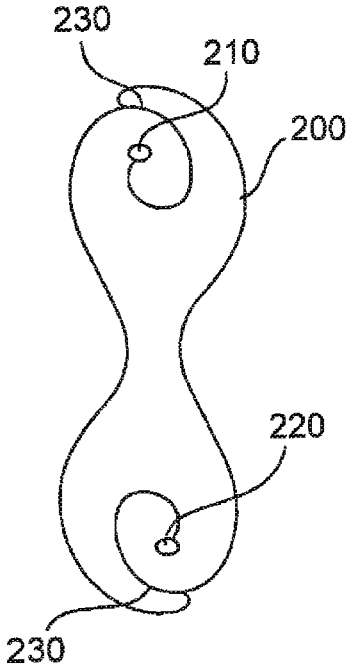
FIG. 4 shows a diagrammatic view of a damping unit according to a third embodiment.

FIG. 4 shows a diagrammatic view of a damping unit in a third embodiment of the invention. The damping unit 200 is of an elongate configuration and has a first opening or receiving bore 210 and a second opening or receiving bore 220. There is also a spiral-shaped introduction opening 230, through which the connecting cable can be introduced. The spiral-shaped introduction opening is intended to prevent the connecting cable being unintentionally removed from the first and second openings 210, 220.

Figure 5:
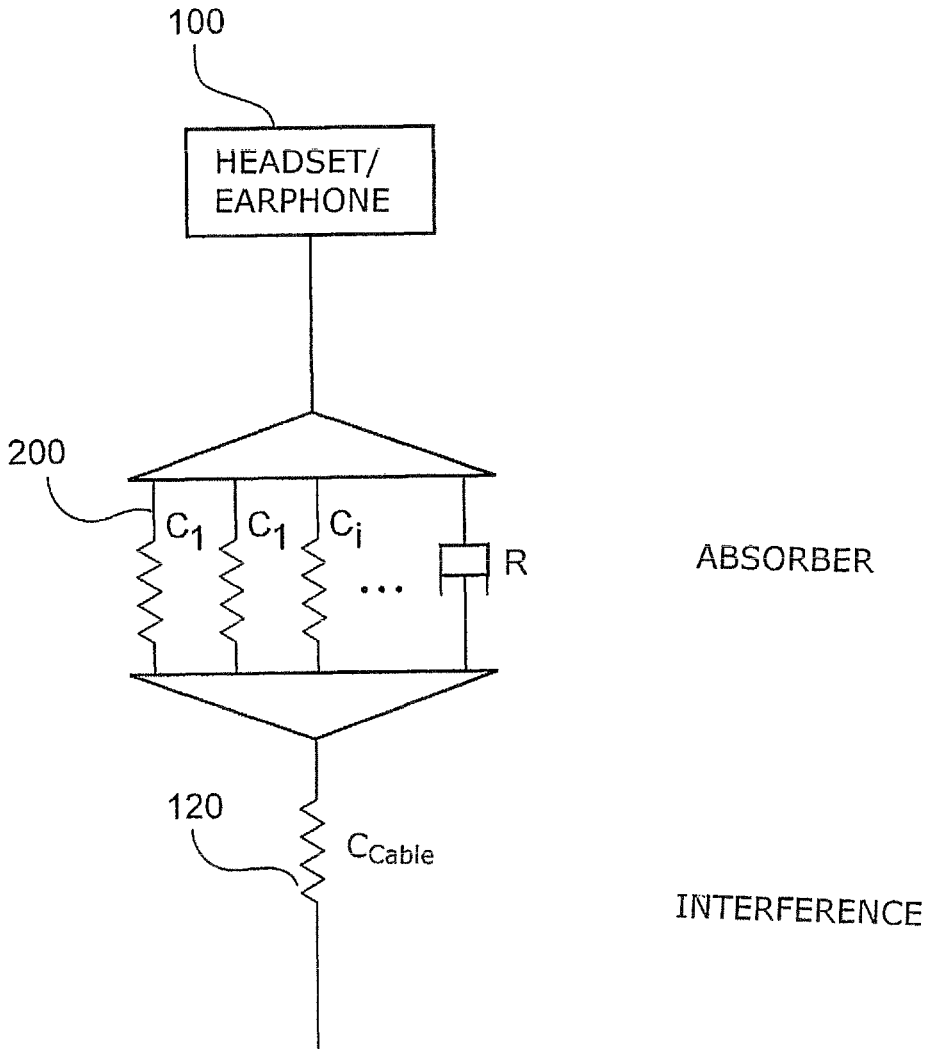
FIG. 5 shows an acoustic equivalent-circuit diagram of an earphone according to the invention.

FIG. 5 shows an acoustic equivalent-circuit diagram of an earphone or headset according to the embodiments of the invention. Thus in FIG. 5 the earphone 100 or the headset 100 and the cable 120 are shown as acoustic interference and the damping unit 200 is shown as an acoustic absorber.

Figure 6:
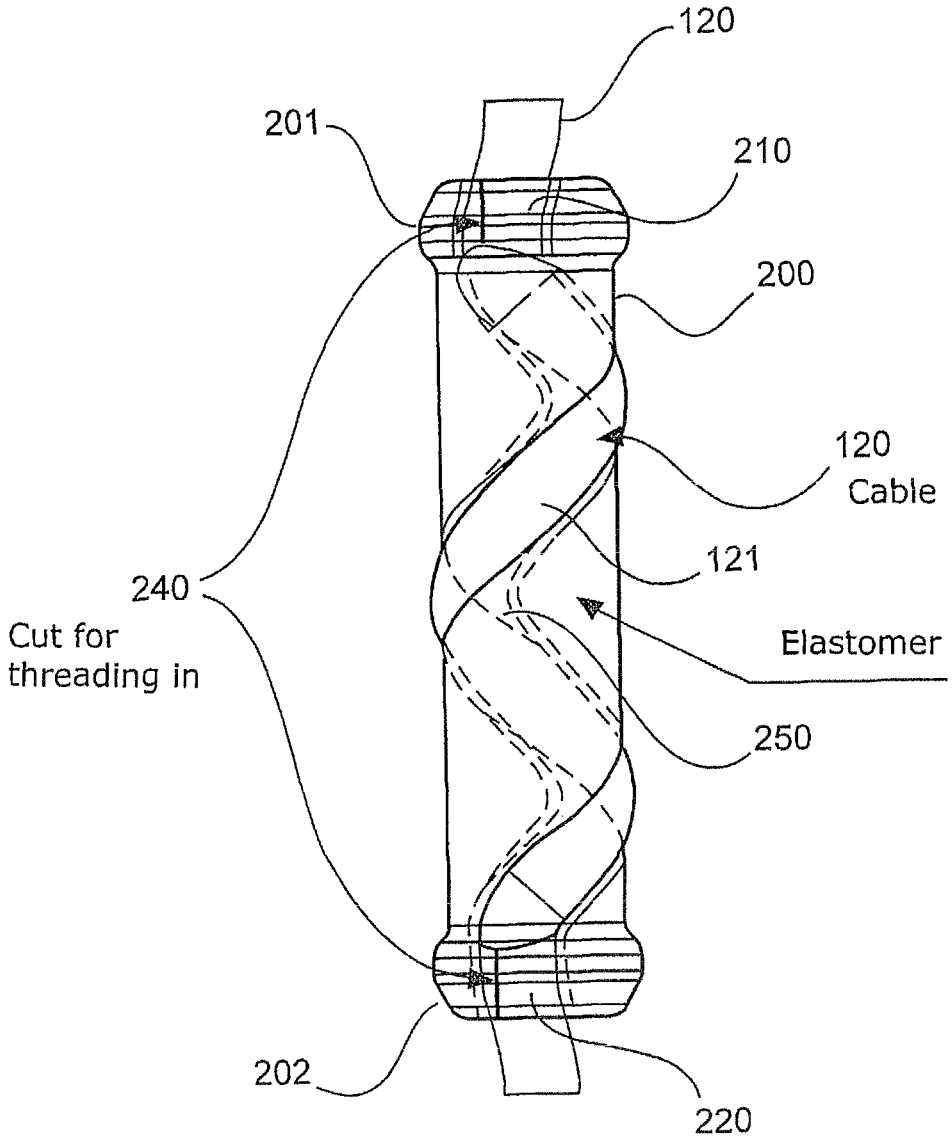
FIG. 6 shows a diagrammatic view of a damping unit according to a fourth embodiment.

FIG. 6 shows a diagrammatic view of a damping unit according to a fourth embodiment. The damping unit 200 has a first opening 210 at a first end 201 and a second opening 220 at a second end 202. The first and second openings can be provided at the ends of the damping unit 200. The two openings 210, 220 serve to receive a connecting cable of an earphone or headset. The damping unit 200 of the fourth embodiment is of a substantially cylindrical configuration and has for example a peripherally extending spiral groove 250 extending from the first to the second opening 210, 220. The width of the groove is greater than the diameter of the connecting cable so that the cable has clearance when it is in the groove.

The effect of the damping unit 200 of the fourth embodiment substantially corresponds to the effect of the damping unit of the first, second or third embodiment. The damping unit 200 has a spring action so that the cable can stretch in its longitudinal direction without the lengthwise stretching being transmitted to the ear caps.

Optionally two cuts 240 are provided in the region of the first and second openings 210, 220, the cuts 240 serving for threading in the cable 120.

Optionally the first and second openings 210, 220 are at the ends of the damping unit. Alternatively the openings 210, 220 can also represent through bores.

The first and second openings 210, 220 have to be adapted in their diameter to the outside diameter of the connecting cable 120. The connecting cable 120 must fit securely in the first and/or second opening 210, 220 so that the solids-borne sound which is propagated along the connecting cable 120 can go on to the damping unit 200. The solids-borne sound is then suitably damped within the damping unit so that it cannot be propagated beyond the damping unit.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

The invention claimed is:

1. An earphone comprising:

at least one electroacoustic reproduction transducer for the reproduction of audio signals;

an electric connecting cable; and a damping unit for damping solids-borne sound transmitted by the connecting cable, where the damping unit is in the form of a separate component;

wherein the damping unit has a first and a second opening for receiving the connecting cable;

wherein the electric connecting cable is threaded in through the fast and second openings;

wherein a length of a portion of the connecting cable between the first and second openings is greater than the distance between the first and second openings; and wherein the damping unit has a slot for threading the connecting cable in and out, the slot being between one of:

the first opening and an outside of the damping unit;

the second opening and an outside of the damping unit; and the first and second openings, and an outside of the damping unit.

2. The earphone as set forth in claim 1;

wherein the slot is of a spiral configuration.

3. The earphone as set forth in claim 1;

wherein the material of the damping unit is a material different from the material of the connecting cable.

4. The earphone as set forth in claim 1;

wherein the material of the damping unit is of a hardness of between 55 and 95 Shore A.

5. The earphone as set forth in claim 2;

wherein the material of the damping unit is a material different from the material of the connecting cable.

6. The earphone as set forth in claim 2;

wherein the material of the damping unit is of a hardness of between 55 and 95 Shore A.

7. The earphone as set forth in claim 3;

wherein the material of the damping unit is of a hardness of between 55 and 95 Shore A.

8. The earphone as set forth in claim 5;

wherein the material of the damping unit is of a hardness of between 55 and 95 Shore A.

9. A headset comprising:

at least one electroacoustic reproduction transducer for the reproduction of audio signals;

an electric connecting cable; and a damping unit for damping solids-borne sound transmitted by the connecting cable, where the damping unit is in the form of a separate component;

wherein the damping unit has a first and a second opening for receiving the connecting cable;

wherein the electric connecting cable is threaded in through the first and second openings;

wherein a length of a portion of the connecting cable between the first and second openings is greater than the distance between the first and second openings; and wherein the damping unit has a slot for threading the connecting cable in and out, the slot being between one of:

the first opening and an outside of the damping unit;

the second opening and an outside of the damping unit; and the first and second openings, and an outside of the damping unit.

* * * * *

UNITED STATES PATENT AND TRADEMARK OFFICE

CERTIFICATE OF CORRECTION

PATENT NO. : 8,755,554 B2
APPLICATION NO. : 13/472573
DATED : June 17, 2014
INVENTOR(S) : Kuhtz et al.

It is certified that error appears in the above-identified patent and that said Letters Patent is hereby corrected as shown below:

On the title page item [73], should read -- Sennheiser electronic GmbH & Co. KG --

Signed and Sealed this
Twenty-sixth Day of January, 2016

Michelle K. Lee

Michelle K. Lee
*Director of the United States Patent and Trademark Office*